US007566201B2

(12) United States Patent
Brillert et al.

(10) Patent No.: US 7,566,201 B2
(45) Date of Patent: Jul. 28, 2009

(54) TURBINE SEAL PLATE LOCKING SYSTEM

(75) Inventors: Dieter Brillert, Rodgau (DE); Oran Bertsch, Titusville, FL (US)

(73) Assignee: Siemens Energy, Inc., Orlando, FL (US)

( * ) Notice: Subject to any disclaimer, the term of this patent is extended or adjusted under 35 U.S.C. 154(b) by 190 days.

(21) Appl. No.: 11/699,801

(22) Filed: Jan. 30, 2007

(65) Prior Publication Data

US 2008/0181767 A1 Jul. 31, 2008

(51) Int. Cl.
*F01D 5/32* (2006.01)

(52) U.S. Cl. ..... 416/221; 416/220 R; 416/248; 29/889.2; 29/889.21

(58) Field of Classification Search ..... 416/95, 416/96 R, 97 R, 215–218, 220 R, 221, 248; 29/889.2, 889.21, 889.22
See application file for complete search history.

(56) References Cited

U.S. PATENT DOCUMENTS

| | | | | |
|---|---|---|---|---|
| 3,096,074 | A * | 7/1963 | Pratt et al. | 416/215 |
| 3,501,249 | A * | 3/1970 | Scalzo et al. | 416/95 |
| 3,572,966 | A | 3/1971 | Borden | |
| 3,644,058 | A | 2/1972 | Barnabei et al. | |
| 3,728,042 | A | 4/1973 | Hugoson et al. | |
| 3,748,060 | A | 7/1973 | Hugoson et al. | |
| 3,853,425 | A | 12/1974 | Scalzo et al. | |
| 4,507,052 | A * | 3/1985 | Thompson | 416/95 |
| 4,523,890 | A | 6/1985 | Thompson | |
| 4,648,799 | A | 3/1987 | Brown et al. | |
| 4,669,959 | A | 6/1987 | Kalogeros | |
| 4,803,893 | A * | 2/1989 | Bachinski | 416/220 R |
| 4,890,981 | A | 1/1990 | Corsmeier et al. | |
| 5,735,671 | A * | 4/1998 | Brauer et al. | 416/95 |
| 5,954,477 | A * | 9/1999 | Balsdon | 416/95 |
| 6,273,683 | B1 | 8/2001 | Zagar et al. | |
| 6,416,282 | B1 | 7/2002 | Beeck et al. | |
| 6,454,526 | B1 | 9/2002 | Cunha et al. | |
| 6,561,764 | B1 | 5/2003 | Tiemann | |
| 2008/0008593 | A1 * | 1/2008 | Zagar et al. | 416/220 R |

FOREIGN PATENT DOCUMENTS

| | | |
|---|---|---|
| EP | 0921272 A2 | 6/1999 |
| GB | 905582 | 9/1962 |
| GB | 2148404 A | 5/1985 |
| GB | 1512882 | 4/2009 |
| JP | 62029703 A | 2/1987 |

* cited by examiner

*Primary Examiner*—Christopher Verdier

(57) ABSTRACT

A seal plate assembly is provided in a rotor disc for a turbine engine. The seal plate assembly includes a radially extending flange on the disc and an annular groove defined between a radial surface on the flange and a face of the disc. An annular outer surface extends axially in facing relationship to an annular inner surface of the groove. A plate structure is supported between the inner and outer surfaces, and a lock structure is provided for holding the plate structure in place. The lock structure includes an axial leg that is adapted to be located between an inner edge of the plate structure and the inner surface of the groove, and the lock structure further includes a radial leg that is adapted to be located between the radial surface on the flange and an outwardly facing surface of the plate structure.

17 Claims, 6 Drawing Sheets

TURBINE SEAL PLATE LOCKING SYSTEM

FIELD OF THE INVENTION

The present invention relates generally to turbine blades and, more particularly, to a structure for providing a seal at the axial end face of a rotor disc for a gas turbine engine.

BACKGROUND OF THE INVENTION

Generally, combustion turbines have three main assemblies, including a compressor assembly, a combustor assembly, and a turbine assembly. In operation, the compressor assembly compresses ambient air. The compressed air is channeled into the combustor assembly where it is mixed with a fuel. The fuel and compressed air mixture is ignited creating a heated working gas. The heated working gas is typically at a temperature of between 2500 to 2900° F. (1371 to 1593° C.), and is expanded through the turbine assembly. The turbine assembly generally includes a rotating assembly comprising a centrally located rotating shaft supporting rotor discs and a plurality of rows of rotating rotor blades attached thereto. A plurality of stationary vane assemblies including a plurality of stationary vanes are connected to a casing of the turbine and are located interposed between the rows of rotor blades. The expansion of the working gas through the rows of rotor blades and stationary vanes in the turbine assembly results in a transfer of energy from the working gas to the rotating assembly, causing rotation of the shaft. A known construction for a combustion turbine is described in U.S. Pat. No. 6,454,526, which patent is incorporated herein by reference.

It is known that higher inlet operating temperatures in the turbine assembly will provide higher thermal efficiency and specific power output. It is also known that the allowable stress to which the rotor blades of the turbine assembly can be subjected for a given blade life decreases with increasing temperatures of the working gas. Thus, a limiting factor in raising turbine efficiency and power output is the physical capability of the rotor blades in relation to the temperatures within the turbine.

Cooling the blades, or forming the blades from temperature resistant materials, or both, is often necessary to reach the desired inlet temperatures. Cooling the blades can be accomplished by using a cooling fluid, such as some of the air normally supplied to the turbine by the compressor in its regular mode of operation. It is known to provide radial passages for directing the cooling fluid through the blades where a portion of a blade may be abutted against a seal plate engaged in grooves in the rotor disc and in the blade. The seal plates may secure the blades to the rotor disc by preventing axial movement of the blades relative to blade mounting recesses in the disc. In addition, the seal plates may seal cooling fluid flow paths that extend to the upstream and/or downstream sides of the blades adjacent lower surfaces of blade platforms defining an inner flowpath for the working fluid.

U.S. Pat. No. 3,572,966 discloses a seal plate for rotor blades in which sideplates are described as fitting within grooves formed in a rotor disc and in rotor blades. The sideplates are located and retained in position by bolts and retaining pins and clips. In such an arrangement multiple parts must be manipulated during assembly, increasing the difficulty of the assembly operation, and maintenance difficulties may arise during disassembly due to breakage of the bolts.

U.S. Pat. No. 3,853,425 discloses a structure for sealing and locking rotor blades into a rotor, and for cooling the blades. The structure includes a plate at the downstream side of a cavity beneath each blade root and prevents cooling fluid in the cavity from leaking downstream out of the cavity. An inner edge of the plate fits in a groove formed on the rotor disc periphery, and an outer portion of the plate engages a groove in the blade root to prevent the plate from sliding circumferentially in the groove. An additional seal and locking plate is provided at the downstream side of the blade root and is locked in a groove in a blade platform to prevent axial movement of the blade. In addition, a special seal and locking plate is provided as the last plate to be inserted between the blade and the rotor disc which are inserted into a channel in the end of a rotor disc, and special indexing lock screws and lock washers are provided to hold the last plate in place.

Accordingly, there continues to be a need for a seal plate system that minimizes the number of parts requiring manipulation, and that enables the seal plate to be readily installed and removed from the blade supporting disc during maintenance operations.

SUMMARY OF THE INVENTION

In accordance with one aspect of the invention, a seal plate assembly is provided where the seal plate assembly is provided in a rotor disc for a turbine engine. The seal plate assembly comprises an annular groove including an annular inner surface provided in the disc. An annular outer surface extends axially in facing relationship to the inner surface. A plate structure is adapted to be disposed and supported between the inner and outer surfaces, the plate structure including an inner edge disposed adjacent the inner surface and an outer edge disposed adjacent the outer surface. A lock structure is adapted to be disposed and located between the inner edge of the plate structure and the inner surface of the groove to lock the plate structure in a predetermined position extending between the inner and outer surfaces.

In accordance with another aspect of the invention, a seal plate assembly is provided where the seal plate assembly is provided in a rotor disc for a turbine engine. The seal plate assembly comprises a radially extending flange on the disc and an annular groove defined between a radial surface on the flange and a face of the disc, the groove including an annular inner surface. An annular outer surface extends axially in facing relationship to the inner surface. A plate structure is adapted to be disposed and supported between the inner and outer surfaces, the plate structure including an inner edge disposed adjacent the inner surface and an outer edge disposed adjacent the outer surface. A lock structure including an axial leg is adapted to be disposed and located between the inner edge of the plate structure and the inner surface of the groove, and the lock structure further includes a radial leg adapted to be disposed and located between the radial surface on the flange and an outwardly facing surface of the plate structure.

In accordance with a further aspect of the invention, a method of providing a seal plate assembly in a rotor disc for a turbine engine is described. The method comprises providing a radially extending flange on the disc and an annular groove defined between a radial surface on the flange and a face of the disc, the groove including an annular inner surface; providing an annular outer surface extending axially in facing relationship to the inner surface; moving a plate structure between the inner and outer surfaces, the plate structure including an inner edge disposed adjacent the inner surface and an outer edge disposed adjacent the outer surface; and moving a lock structure from an installation position to a lock position, the lock structure including an axial leg adapted to be disposed and located between the inner edge of the plate structure and the inner surface of the groove in the lock position, and the lock structure including a radial leg adapted to be disposed and located between the radial surface on the flange and an outwardly facing surface of the plate structure in the lock position.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
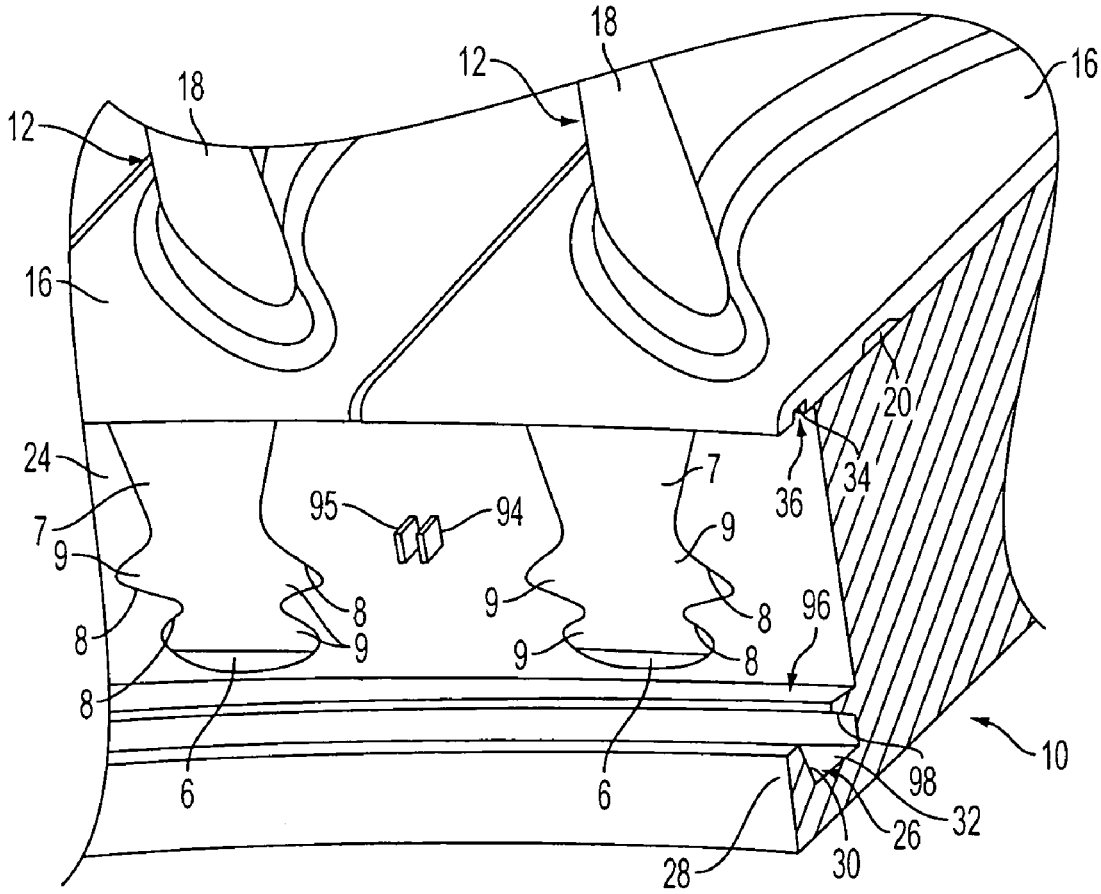
FIG. 1 is a partial front perspective view of an upstream side of a rotor disc configured for mounting seal plate structures in accordance with the present invention.

FIG. 1 illustrates a basic construction of part of a turbine rotor in a turbine assembly for a combustion turbine engine, such as a gas turbine engine, and in particular illustrates an outer peripheral portion of a disc 10 for the rotor. It should be noted that although the portion of the disc 10 illustrated in the figures appears as a disc segment, the disc 10 is preferably formed as a substantially continuous ring structure within the turbine assembly.

The disc 10 defines peripheral blade mounting sections comprising axially extending peripheral recesses 6 for receiving the root portions 7 of rotor blades 12. The recesses 6 may be provided with undercuts 8. A rotor blade 12 is inserted with its root portion 7 passing through the recess 6 in the axial direction of the recess 6. The root portion 7 is supported with longitudinal ribs 9 on the undercuts 8 of the recess 6. In this way, during rotation of the disc 10 about the longitudinal axis of the rotor, the blade 12 is held counter to centrifugal forces occurring in the direction of a longitudinal axis of an airfoil 18 of the blade 12. The blade 12 is further secured against movement out of the recess 6 in the direction of insertion, i.e., in the longitudinal direction of the recess 6, by additional means comprising a seal plate assembly 14 (see FIG. 2), as will be described further below. It should be noted that although the following description is particularly directed to a portion of the seal plate assembly 14 provided to the upstream side of the disc 10, the present invention additionally may be applied to the downstream side of the disc 10, where a seal plate assembly 14 for the downstream side is substantially similar to the structure described for the upstream side of the seal plate assembly 14.

Figure 2:
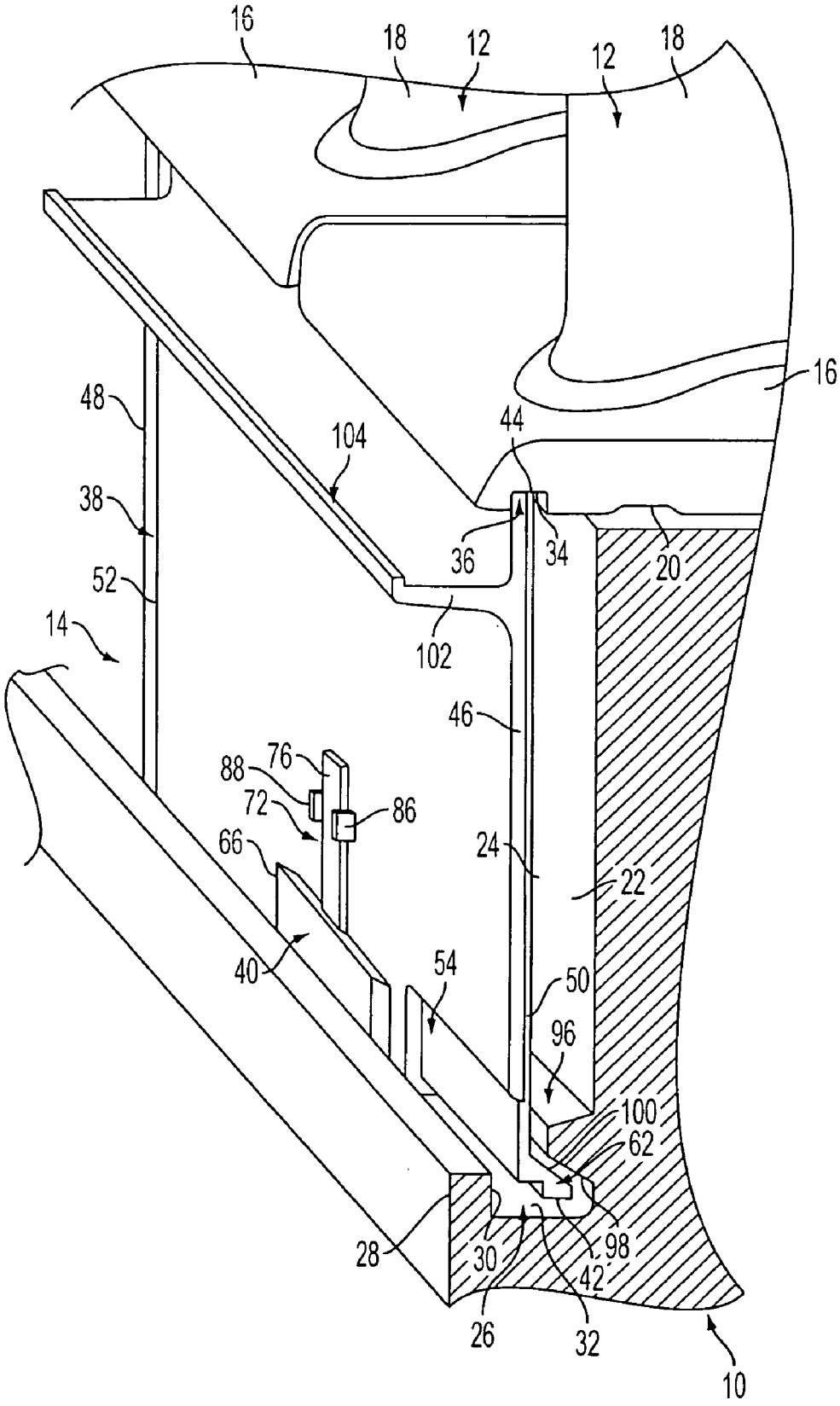
FIG. 2 is a perspective view of a seal plate structure mounted to a side of the rotor disc.

Referring to FIGS. 1 and 2, each blade 12 supported on the disc 10 includes a widened region comprising a blade platform 16. The airfoil 18 of the blade 12 is located on an outer side of the blade platform 16, where the outer side is located opposite a disc-side base 20 of the blade platform 16. The hot working gas required for operating the turbine engine flows past the airfoils 18 of the blades 12 to generate a torque on the disc 10 and rotate a drive shaft (not shown) of the turbine engine. In order to enable the blades 12 to operate at high operating temperatures of the turbine assembly, a cooling fluid such as a cooling air flow, is typically provided to an internal cooling system (not shown) passing through the airfoil 18 and adjacent to the blade root portions 7. The disc 10 may include radial passages (not shown) for directing a cooling air flow from a passageway, providing air from the compressor for the engine, radially outwardly through the disc 10 to the recess 6 receiving the root portion 7. The cooling air may flow axially along the recess 6 of the disc 10 to the ends of the disc 10 and the blade root portions 7.

The seal plate assembly 14 facilitates sealing the disc-side base 20 of the blades 12 and the blade root portions 7 from the hot working fluid. In addition, the seal plate assembly 14 facilitates directing cooling fluid though continuous circumferential passages or chambers 22 adjacent the longitudinal or axial end of the disc 10, defined by an end face 24.

As seen in FIGS. 1 and 2, the disc 10 includes an annular, continuous groove 26 or channel defined between the end face 24 and a radially extending flange 28, defining a radial surface 30. The groove 26 defines an annular inner surface 32 extending in an axial direction between the end face 24 and the radial surface 30, the radial surface 30 extending substantially perpendicular to the inner surface 32. An annular outer surface 34 is defined on a surface of the blade platform 16 facing toward the inner surface 32 and, in the illustrated embodiment, is formed as an axially extending surface located within a groove 36 in the blade platform 16.

Figure 3:
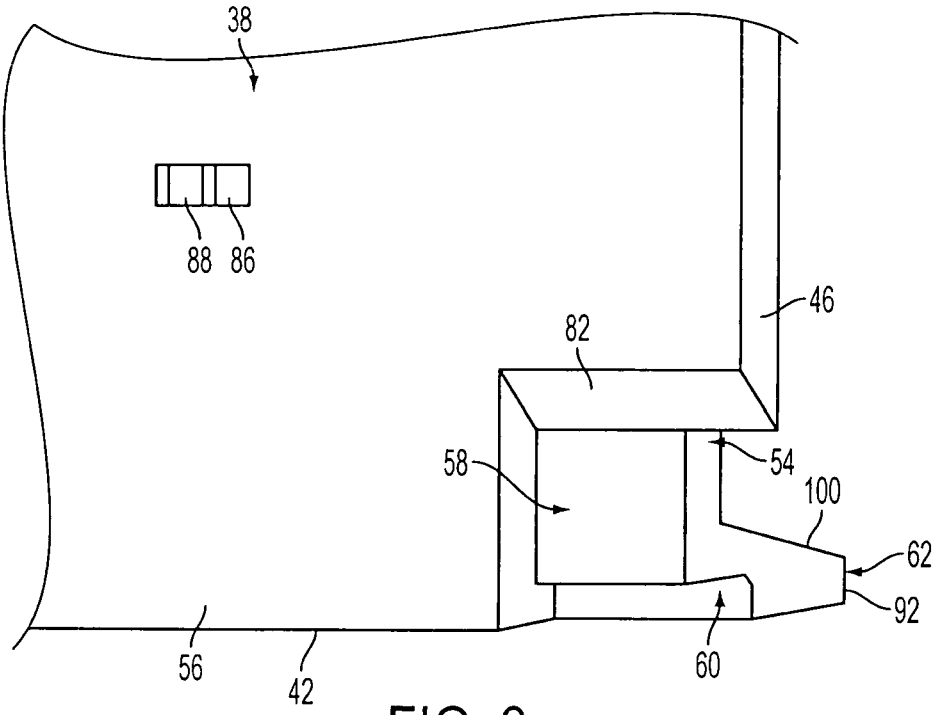
FIG. 3 is an enlarged view of an inner lateral edge portion of the seal plate structure showing a slot portion for receiving a lock structure.
Figure 6:
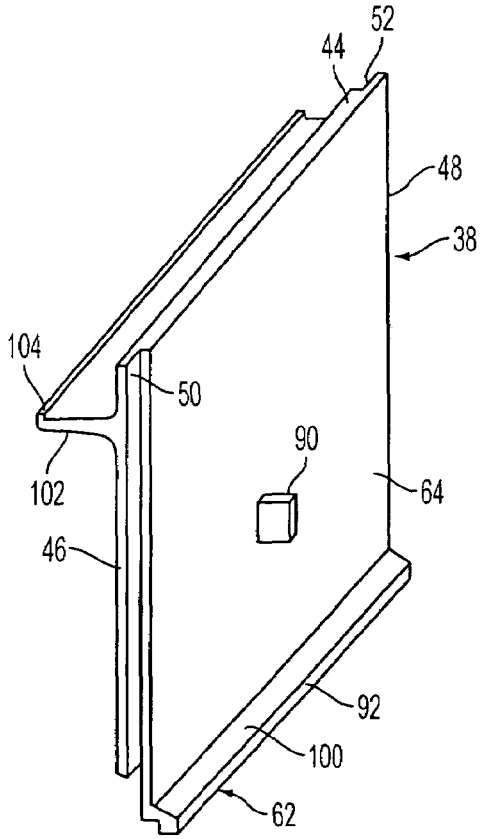
FIG. 6 is a perspective view of an inwardly facing side of the seal plate structure.

Referring to FIGS. 2, 3 and 6, the seal plate assembly 14 comprises a seal plate structure 38 and a lock structure 40 located in association with the seal plate structure 38. The seal plate structure 38 is a generally planar member and includes an inner edge 42 that is adapted to be disposed adjacent the inner surface 32 of the groove 26, and an outer edge 44 that is adapted to be disposed adjacent the outer surface 34 defined on the blade platform 16. In addition, opposing lateral edges 46, 48 extend between the inner edge 42 and outer edge 44. The lateral edges 46, 48 are illustrated as being formed with respective recess portions 50, 52 to form ship-lap joints between adjacent seal plate structures 38. It should be understood that the present invention is not limited to the particular structure illustrated herein for the joints provided between the cooperating edges 46, 48 of adjacent seal plate structures 38. For example, one or more of the seal plate structures 38 may be formed with both recess portions 50, 52 facing in the same direction to facilitate installation of the seal plate structures 38, or other constructions for the lateral edges 46, 48 may be included to ensure sealing between adjacent seal plate structures 38.

As seen in FIG. 3, the seal plate structure 38 includes a slot 54 located adjacent the inner edge 42 and the lateral edge 46 and extending inwardly from an outwardly facing surface 56 of the seal plate structure 38. The slot 54 comrprises a generally L-shaped area or recess and includes a radial portion 58 extending radially up from the inner edge 42 of the seal plate structure 38, and an axial portion 60 extending axially inwardly from the outwardly facing surface 56 adjacent and radially upwardly from the inner edge 42. It may be noted that the seal plate structure 38 includes a lip portion 62 extending axially from an inwardly facing surface 64 (see FIG. 6) of the seal plate structure 38, and the axial portion 60 of the slot 54 may extend up to and/or axially inwardly beyond the radial portion 58 into the area defined by the lip portion 62.

Figure 4:
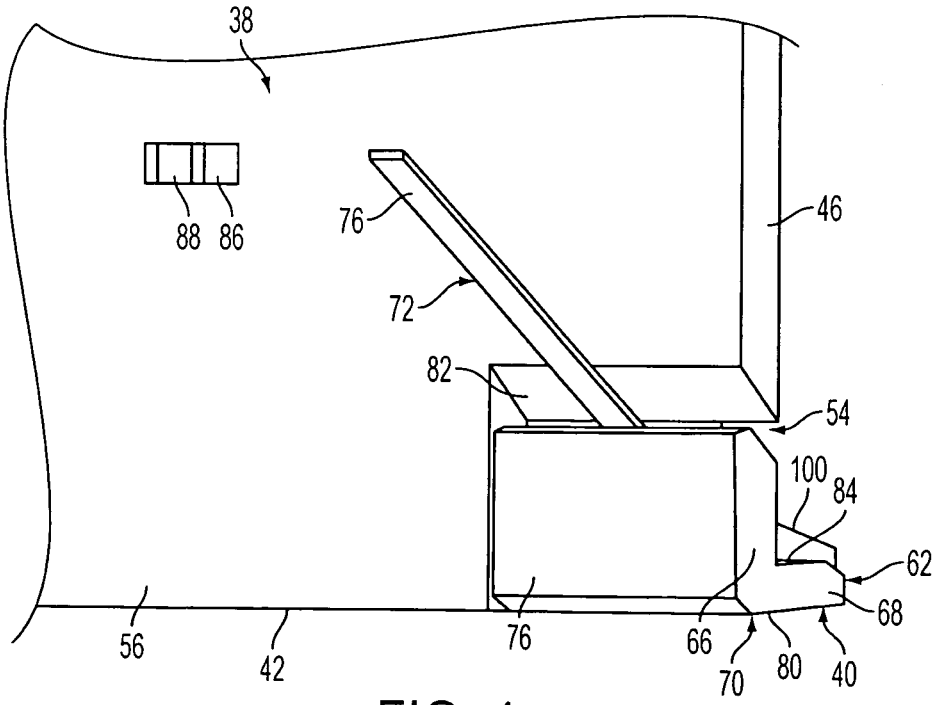
FIG. 4 is an enlarged view similar to FIG. 3 with the lock structure located within the slot portion in an installation position of the lock structure.
Figure 5:
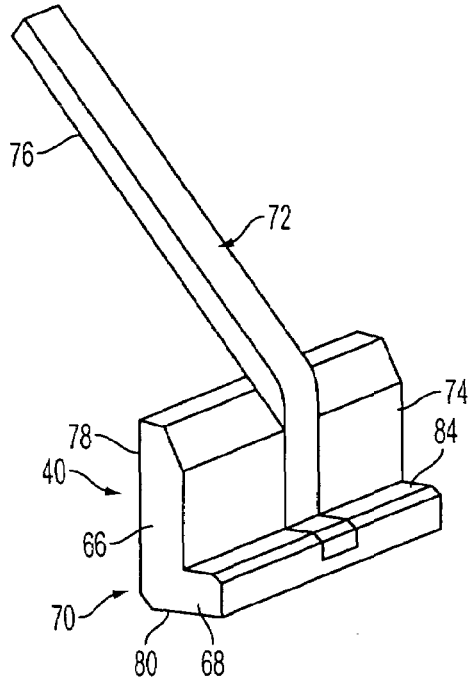
FIG. 5 is a perspective view of the lock portion, showing an inwardly facing side thereof.

Referring to FIGS. 4 and 5, the lock structure 40 comprises a radial leg 66 and an axial leg 68 extending generally perpendicular to the radial leg 66 to define an L-shaped body 70. An elongated member or pointer 72 is rigidly attached to the L-shaped body 70 and extends along an inner side 74 of the radial leg 66 and, in an installation orientation of the pointer 72, an outer end 76 of the pointer 72 extends at an angle from an outer side 78 of the radial leg 66. The lock structure 40 is configured such that, in an installation position of the lock structure 40, the radial leg 66 fits within the radial portion 58 of the slot 54 with the outer side 78 substantially flush with the outwardly facing surface 56 of the seal plate structure 38, and the axial leg 68 fits within the axial portion 60 of the slot 54 with an inner side 80 of the axial leg 68 substantially flush with the inner edge 42 of the seal plate structure 38. In addition, an outer side 82 of the radial portion 58 may be tapered or angled inwardly to accommodate the angled extension of the outer end 76 of the pointer 72.

In a lock position of the lock structure 40, the lock structure 40 is positioned with an outer side 84 of the axial leg 68 adjacent to the inner edge 42 of the seal plate structure 38 (see FIG. 8) and with the inner side 74 of the radial leg 66 located adjacent the outwardly facing side 56 of the seal plate structure 38. In addition, the lock structure 40 is positioned circumferentially, such as by sliding through the groove 26, to a location where the pointer 72 is aligned with a pair of tabs 86, 88 extending axially from the outer side 56 of the seal plate structure 38. As is illustrated in FIG. 2, the pointer 72 may be inelastically bent to position the outer end 76 between the tabs 86, 88 and thereby prevent circumferential movement of the lock structure 40.

Referring to FIG. 6, the seal plate structure 38 may include an alignment tab 90 for locating the seal plate structure 38 at a predetermined circumferential position relative to the disc 10. In particular, the tab 90 comprises a radially elongated tab that extends axially from the inwardly facing surface 64 of the seal plate structure 38 to engage between a pair of tabs 94, 95 extending axially from the end face 24 of the disc 10 (see FIG. 1). Further, a ledge portion 96 is provided extending axially from the end face 24 and includes an angled surface 98 for engaging an angled cooperating surface 100 of the lip portion 62 to radially position and carry any centrifugal forces exerted on the seal plate structure 38. It should be understood that, alternatively, the tabs 94, 95 may be formed on the ends of the root portions 7 of the blades 12. Further, although the surfaces 98 and 100 are illustrated as angled surfaces, they may be formed as extending substantially perpendicular to the end face 24.

Referring to FIGS. 2 and 6, it should be noted that the seal plate structure 38 may additionally include a seal arm 102 extending from the outwardly facing surface 56 of the seal plate structure 38. The seal arm 102 includes an end portion 104 for cooperating with a stationary seal member (not shown) of the turbine for limiting passage of hot working gases to the disc area of the turbine.

Figure 7:
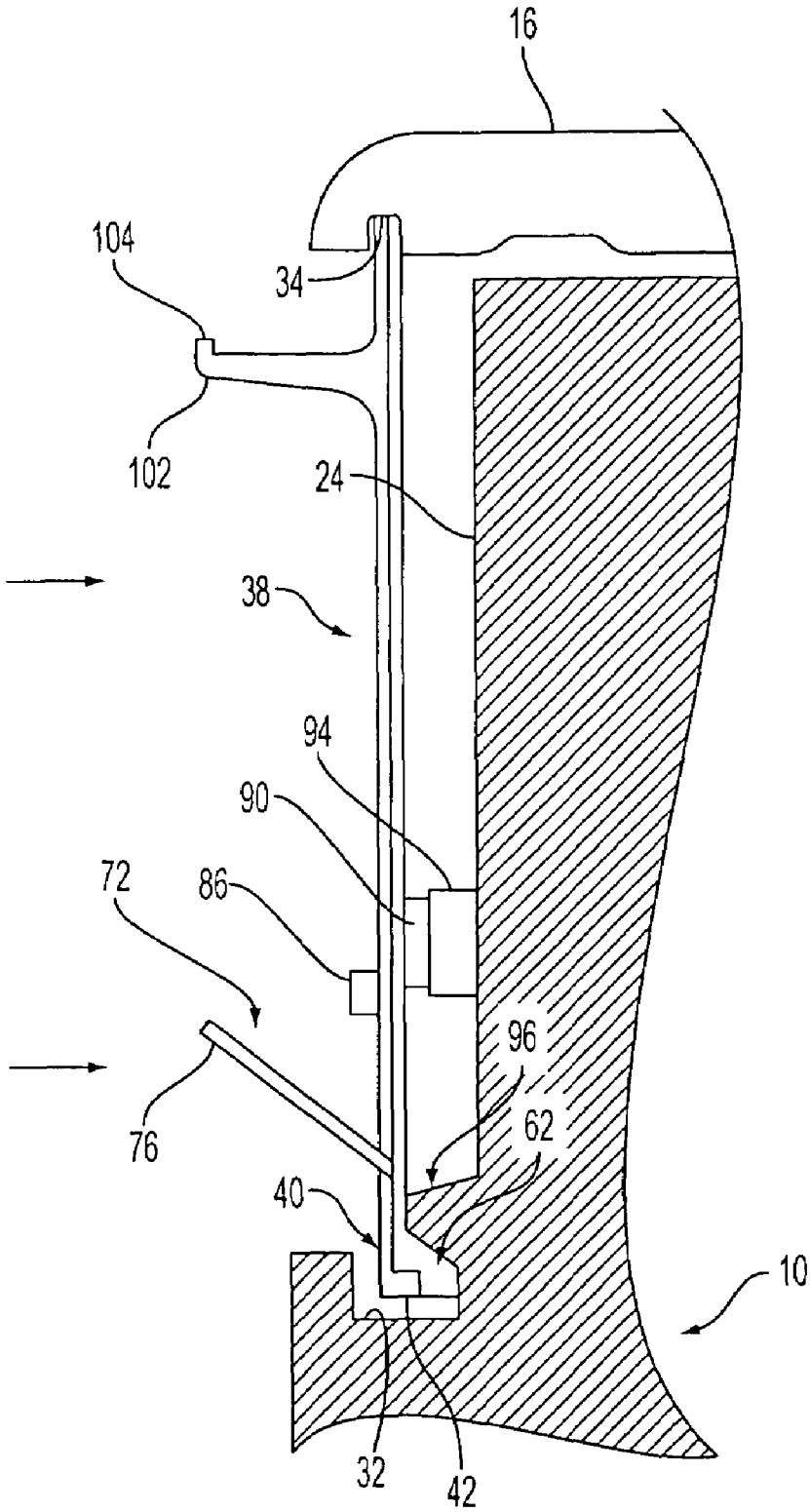
FIGS. 7 and 8 are side views illustrating installation of the seal plate assembly.

Referring to FIG. 7, the seal plate assembly 14 may be assembled by moving the seal plate structure 38, with the lock structure 40 positioned in the installation position within the slot 54, in an axial direction toward the end face 24 of the disc 10 in order to locate the seal plate assembly 38 between the inner surface 32 and the outer surface 34. The axial movement of the seal plate structure 38 may require that the seal plate structure 38 be angled to initially position the inner edge 42 of the seal plate structure 38 into the groove 26, and then moving the upper edge 44 into alignment with the groove 36 in the blade platform 16. Subsequently, the seal plate structure 38 is positioned radially outwardly to locate the upper 44 edge adjacent the outer surface 34, and to position the surface 100 of the lip portion 62 in engagement with the surface 98 of the ledge portion 96. The circumferential position of the seal plate structure 38 is such that the tab 90, defining a first circumferential locking feature, is aligned to engage between the tabs 94, 95 (see FIG. 6), defining a second circumferential locking feature, to prevent circumferential movement of the seal plate structure 38. It should be noted that the circumferential locking structure for the present invention is not limited to the particular tab structure defined by the tabs 90 and 94, 95. For example, the seal plate structure 38 may be provided with a pair of tabs, and a single tab may be provided in association with the disc 10, i.e., extending either from the end face 24 of the disc 10 or from the blade root portions 7, for cooperating to prevent circumferential movement of the seal plate structure 38.

Figure 8:
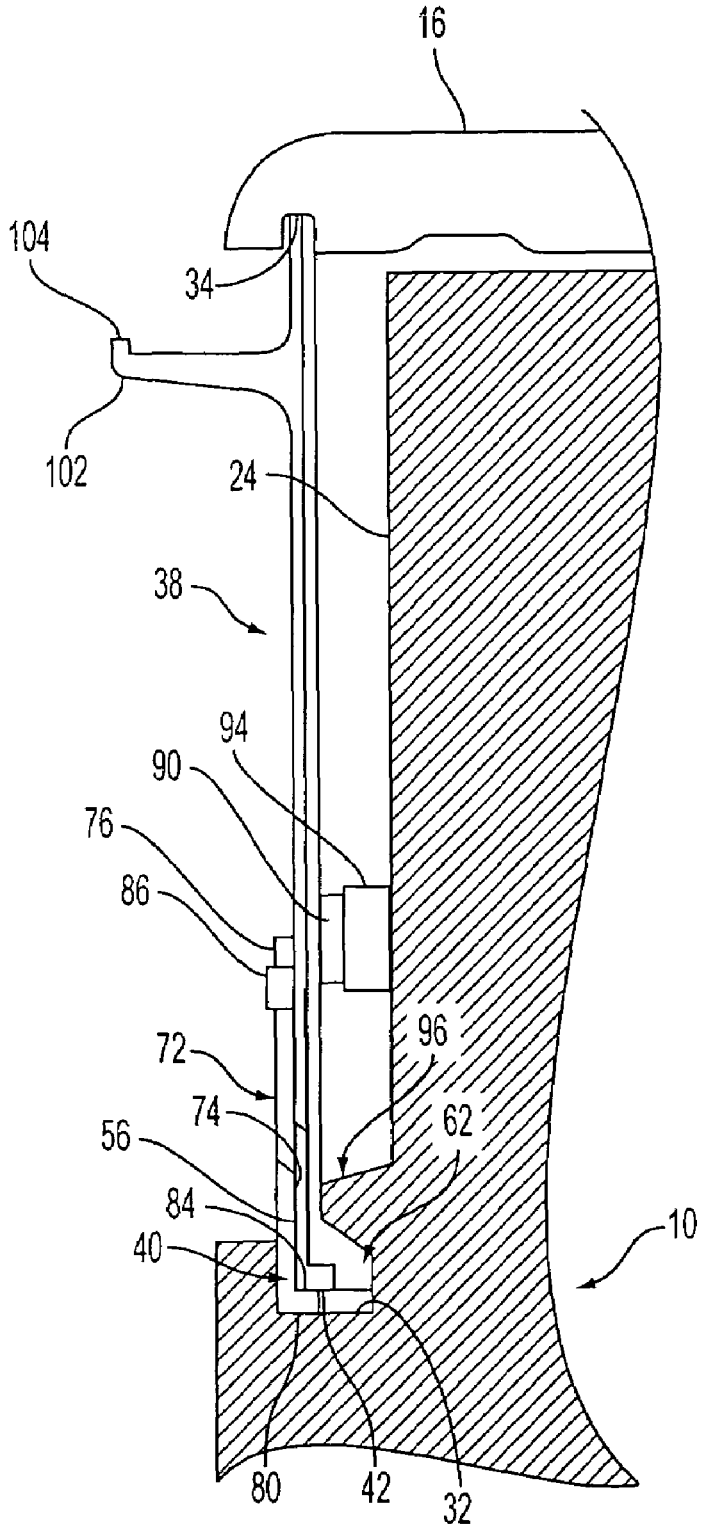

Referring to FIGS. 2 and 8, the seal plate structure 38 is then locked in place by initially moving the lock structure 40 radially inwardly toward the inner surface 32 and axially outwardly toward the radial surface 30 of the flange 28, thereby disengaging the lock structure from the slot 54. The pointer 72 may be used to facilitate manipulation and movement of the lock structure 40, and the lock structure 40 may be moved to the position in alignment with the tabs 86, 88. A step of bending the pointer 72 is then performed, where the pointer 72 is bent toward the outwardly facing surface 56 to position the outer end 76 between the tabs 86, 88. In this position of the lock structure 40, the axial leg 68 substantially fills a space between the inner surface 32 and the inner edge 42 of the seal plate structure 38, and the radial leg 66 substantially fills a space between the radial surface 30 and the outwardly facing surface 56 of the seal plate structure 38, whereby radial and axial movement of the seal plate structure 38 is substantially limited or prevented.

It should be understood that although a preferred embodiment of the seal plate assembly 14 has been illustrated in association with a blade having a blade platform 16 in engagement with the outer edge 44 of the seal plate structure 38, other structures may be provided for cooperating the seal plate structure 38. For example, in an alternative embodiment, the disc 10 may be formed with a structure extending axially from the end face 24 in facing relationship to the inner surface 32 and defining an outer surface for cooperating with the outer edge 44 of the seal plate structure 38.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A seal plate assembly in a rotor disc for a turbine engine, the seal plate assembly comprising:

an annular groove including an annular inner surface provided in said disc, said inner surface facing radially outwardly;

an annular outer surface extending axially in facing relationship to said inner surface;

a plate structure adapted to be disposed and supported between said inner and outer surfaces, said plate structure including an inner edge, facing radially inwardly and disposed adjacent said inner surface and an outer edge disposed adjacent said outer surface, said plate structure further including an outwardly facing surface and an opposite inwardly facing surface;

a slot formed in the plate structure, said slot comprising an L-shaped recess in said plate structure and including a radial portion extending radially upwardly from said inner edge toward said outer edge and an axial portion extending axially inwardly from said outwardly facing surface, said axial portion extending axially inwardly beyond said radial portion and radially upwardly from said inner edge; and a lock structure including a radial leg and an axial leg extending perpendicular to said radial leg to define an L-shaped body, said lock structure adapted to be located in an installation position with said radial leg fitting within said radial portion of said slot and with said axial leg fitting within said axial portion of said slot, and said lock structure adapted to be moved to a lock position at a location disengaged from said slot such that said lock structure is disposed and located with said radial leg engaging said outwardly facing surface of said plate structure and said axial leg engaging said inner edge of said plate structure and filling a space between said inner edge of said plate structure and said inner surface of said groove to lock said plate structure in a predetermined position extending between said inner and outer surfaces.

2. The seal plate assembly of claim 1, wherein said annular groove further includes a radial surface extending substantially perpendicular to said inner surface, and said lock structure further extends between and substantially fills a space between said radial surface and said outwardly facing surface of said plate structure.

3. The seal plate assembly of claim 1, including a pointer on said lock structure extending radially from said radial leg for engaging one or more tabs extending from a face of said plate structure to hold said lock structure in position relative to said plate structure.

4. The seal plate assembly of claim 3, wherein said pointer extends radially from a location adjacent said groove toward said outer surface.

5. The seal plate assembly of claim 1, wherein said outer surface is defined within a groove.

6. The seal plate assembly of claim 5, wherein said groove defining said outer surface is defined in a blade platform of a blade mounted to said disc.

7. The seal plate assembly of claim 1, wherein an inner side of said axial leg of said lock structure is substantially flush with said inner edge of said plate structure in said installation position, and an outer side of said axial leg is engaged on said inner surface of said annular groove in said lock position.

8. The seal plate assembly of claim 1, wherein an outer side of said radial leg of said lock structure is substantially flush with said outwardly facing surface of said plate structure in said installation position, and said outer side of said radial leg is engaged on a radial surface of said annular groove extending substantially perpendicular to said inner surface.

9. A seal plate assembly in a rotor disc for a turbine engine, the seal plate assembly comprising:

a radially extending flange on said disc and an annular groove defined between a radial surface on said flange and a face of said disc, said groove including an annular inner surface;

an annular outer surface extending axially in facing relationship to said inner surface;

a plate structure adapted to be disposed and supported between said inner and outer surfaces, said plate structure including an inner edge disposed adjacent said inner surface and an outer edge disposed adjacent said outer surface;

a lock structure including an axial leg adapted to be disposed and located between said inner edge of said plate structure and said inner surface of said groove, and said lock structure including a radial leg adapted to be disposed and located between said radial surface on said flange and an outwardly facing surface of said plate; and including a pointer on said lock structure extending radially from said radial leg toward said outer surface for engaging between a pair of tabs extending from a face of said plate structure to hold said lock structure in position relative to said plate structure.

10. The seal plate assembly of claim 9, wherein said plate structure includes a slot formed adjacent said inner edge for receiving said lock structure during installation of said plate structure between said inner and outer surfaces.

11. The seal plate assembly of claim 10, wherein said lock structure is movable along said inner edge of said plate structure to position said lock structure in a lock position to lock said plate structure in a predetermined position extending between said inner and outer surfaces.

12. The seal plate assembly of claim 9, wherein said plate structure includes a lip portion extending axially from an inwardly facing surface of said plate structure for engaging an axially extending surface of said disc.

13. A method of providing a seal plate assembly in a rotor disc for a turbine engine, the method comprising:

providing a radially extending flange on said disc and an annular groove defined between a radial surface on said flange and a face of said disc, said groove including an annular inner surface;

providing an annular outer surface extending axially in facing relationship to said inner surface;

moving a plate structure between said inner and outer surfaces, said plate structure including opposing lateral edges, an outwardly facing surface and an opposite inwardly facing surface, an inner edge disposed adjacent said annular inner surface and an outer edge disposed adjacent said annular outer surface, and a slot defined at said inner edge adjacent one of said lateral edges, said slot comprising an L-shaped recess in said plate structure and including a radial portion extending radially upwardly from said inner edge toward said outer edge and an axial portion extending axially inwardly from said outwardly facing surface; and moving a lock structure from an installation position to a lock position comprising disengaging said lock structure from a position in engagement with said slot and moving said lock structure relative to said plate structure laterally in a direction from said one lateral edge toward the other lateral edge to position said lock structure at said lock position, the lock structure including an axial leg located in said axial portion of said slot in said installation position, and said axial leg adapted to be disposed and located in engagement with said inner edge with said axial leg filling a space between said inner edge of said plate structure and said inner surface of said groove in said lock position, and said lock structure including a radial leg located in said radial portion of said slot in said installation position, and said radial leg adapted to be disposed and located between said radial surface on said flange and said outwardly facing surface of said plate structure with said radial leg in engagement with said outwardly facing surface in said lock position.

14. The method of claim 13, wherein said lock structure is positioned in said slot in said installation position during said movement of said plate structure between said inner and outer surfaces.

15. The method of claim 14, wherein said lock structure is movable from said slot along said inner edge of said plate structure during said movement from said one lateral edge toward the other lateral edge to position said lock structure from said installation position to said lock position.

16. The method of claim 15, including bending a pointer attached to said lock structure toward said outwardly facing surface of said plate structure to prevent circumferential movement of said lock structure.

17. The method of claim 13, including the step of positioning a first feature on an inwardly facing surface of said plate structure adjacent to a second feature associated with said face of said disc, where said first and second features cooperate with each other to lock said plate structure against circumferential movement.

* * * * *